US008988843B2

(12) United States Patent
Promutico et al.

(10) Patent No.: US 8,988,843 B2
(45) **Date of Patent: *Mar. 24, 2015**

(54) ACTUATOR MODULE, SYSTEM FOR LOCKING-UNLOCKING A DOOR

(71) Applicant: Bitron S.p.A, Turin (IT)

(72) Inventors: Fabrizio Promutico, Turin (IT); Enrico Adiutori, Turin (IT)

(73) Assignee: Bitron S.p.A., Turin (IT)

( * ) Notice: Subject to any disclaimer, the term of this patent is extended or adjusted under 35 U.S.C. 154(b) by 0 days.

This patent is subject to a terminal disclaimer.

(21) Appl. No.: 13/846,353

(22) Filed: Mar. 18, 2013

(65) Prior Publication Data

US 2013/0294000 A1 Nov. 7, 2013

Related U.S. Application Data

(63) Continuation of application No. PCT/IT2011/000337, filed on Sep. 29, 2011.

(30) Foreign Application Priority Data

Oct. 1, 2010 (IT) ..... RM2010A0513

(51) Int. Cl.

| | |
|---|---|
| ***H01H 47/00*** | (2006.01) |
| ***H01F 7/18*** | (2006.01) |
| ***D06F 37/42*** | (2006.01) |
| ***D06F 39/14*** | (2006.01) |
| ***E05B 47/00*** | (2006.01) |

(52) U.S. Cl.

CPC *H01F 7/18* (2013.01); *D06F 37/42* (2013.01); *D06F 39/14* (2013.01); *E05B 47/0001* (2013.01)

USPC ..... 361/165

(58) Field of Classification Search

USPC ..... 361/106, 165

See application file for complete search history.

(56) References Cited

U.S. PATENT DOCUMENTS

| | | | | |
|---|---|---|---|---|
| 3,916,264 | A * | 10/1975 | Berg | 361/106 |
| 4,945,735 | A * | 8/1990 | Tarrano et al. | 68/12.19 |
| 6,313,723 | B1 * | 11/2001 | Chen et al. | 335/6 |
| 6,334,637 | B1 | 1/2002 | Chioffi | |

FOREIGN PATENT DOCUMENTS

| | | |
|---|---|---|
| EP | 1808558 | 7/2007 |

OTHER PUBLICATIONS

International Search Report mailed Jan. 31, 2012, for PCT/IT2011/000337.

* cited by examiner

*Primary Examiner* — Stephen W Jackson

(74) *Attorney, Agent, or Firm* — Hershkovitz & Associates, PLLC; Abraham Hershkovitz

(57) ABSTRACT

The present invention concerns an actuator module (1) comprising an actuating unit (3), said actuating unit comprising a solenoid (31) having a first (31') and a second (31") electric terminal, capable, when excited, of generating an electromagnetic field and a PTC (Positive Temperature Coefficient) resistor (32) connected in series with said second electric terminal (31) of said solenoid (31), said actuator module (1) being characterized in that said actuating unit (3) can be controlled by activation signals and protection signals, and in that it comprises a switch circuit (33, 34), connected between said first (31') and second (31") electric terminal, said switch circuit (33, 34) allowing the passage of current through said solenoid (31) and said PTC resistor (32) by said activation signals; and preventing the passage of current through said solenoid (31), but allowing the passage of current through said PTC resistor (32), by said protection signals.

The present invention also concerns a system for locking-unlocking a door of a household appliance, such as a washing machine and a method for protecting a locking-unlocking system.

18 Claims, 3 Drawing Sheets

Sez. A-A

ACTUATOR MODULE, SYSTEM FOR LOCKING-UNLOCKING A DOOR

CROSS-REFERENCE TO RELATED APPLICATIONS

The present application is a bypass continuation of PCT/IT2011/000337, filed on Sep. 29, 2011, which claims priority to Italian application RM2010A000513 filled on Oct. 1, 2010, the disclosures of which are expressly incorporated by reference herein in their entirety.

The present invention relates to an actuator module, system for locking-unlocking a door of a household appliance and respective operating method.

More specifically, the invention concerns an enabling or disabling module of any active load by an electric signal properly polarized, immune to any electrical or magnetic noise.

In the following the description will be directed to an application to an electromagnetic actuator for locking or unlocking a door of a household appliance, like a washing machine, but it is clear that the same should not be considered limited to this specific use.

As it is well known there are currently several safety systems to allow the opening or closing a door of a washing machine.

A door locking-unlocking device according to the prior art is described, for example, in U.S. Pat. No. 6,334,637 B1 or in Italian patent application TO2006A000026, both in the ownership of the Applicant. In such systems, the locking-unlocking device comprises essentially a mechanical module, capable to hold or release a prong integral with said door, and an electric module, comprising an activation electromechanical unit. Said activation electromechanical unit is provided with a solenoid and a core movable by the magnetic field generated by said solenoid. Additionally, said activation electromechanical unit comprises a mechanical element, with a hook at one end, and a saw-toothed wheel, with which said hook can be engaged. Said saw-tooth wheel is capable to control, with its appropriate rotation, a safety pin, capable of taking a rest or retracted position, in which it does not interact with said mechanical module, and an active position or extracted, in which it interacts with said mechanical module, to prevent opening of the door when it is closed and the washing machine is turned on or operating.

The above assembly, and said saw-tooth wheel are made so that to extract the safety pin, it is necessary to rotate the saw-toothed wheel of a preset angle, which occurs following activation of the movable core by a first impulse; while, to retract the locking pin, two (at least one, anyway) of the same preset angle rotations of the saw-toothed wheel are needed, that is, then, after two activations of the movable core, i.e. after two impulses.

Therefore, in devices according to prior art, the solenoid current pulse necessary to translate the movable core is about 20 milliseconds or less.

However, when the washing machine or household appliance in general is operating, the safety pin does not return in rest position is required, i.e. it doesn't retract. For this, always in prior art, there is a PTC resistor (Positive Temperature Coefficient resistor) arranged in series with the power terminal of the solenoid. As it is known, PTC resistors increase their resistance proportionally to their temperature and, therefore, to the current flowing through them. Therefore, when the door is closed and the washing machine is activated, the first impulse is extended, i.e. the one to pull the safety pin, for the duration of the operating cycle of the household appliance.

After about one or two seconds, the PTC resistor reaches a resistance of about 15 megaohms, drastically reducing the current through the solenoid and, therefore, its magnetic field. In this way, the movable core returns to rest position and the solenoid is protected from interference signals.

A problem of the devices according to the prior art is that when the device is into protection state, in the time interval that elapses so that the PTC resistor reaches a resistance that reduces the current through the inductor at negligible values, which is, as said above, one or two seconds long, the movable core vibrates, creating an annoying hum.

In light of the above, it is, therefore, an object of the present invention to propose an actuator module immune to electrical or electromagnetic noises that does not generate noises or hums when it is in protection.

Another object of the invention is to propose a door locking-unlocking system of a household appliance employing such actuator module.

A further object of the present invention is to propose an operating method of the actuator module and/or of the locking-unlocking system according to the present invention.

These and other results are obtained according to the invention by an actuator module provided with switching means, so as to be controlled by appropriately polarized signals.

It is therefore a specific object of the present invention an actuator module comprising an actuating unit, said actuating unit comprising a solenoid having a first and a second electric terminal, capable, when excited, of generating an electromagnetic field and a PTC (Positive Temperature Coefficient) resistor connected in series with said second electric terminal of said solenoid, said actuator module being characterized in that said actuating unit can be controlled by activation signals and protection signals, and in that it comprises a switch circuit, connected between said first and second electric terminal, said switch circuit allowing the passage of current through said solenoid and said PTC resistor by said activation signals; and preventing the passage of current through said solenoid, but allowing the passage of current through said PTC resistor, by said protection signals.

Always according to the invention, said activation signals are constituted of pulses having a first polarization and said protection signals are constituted of pulses having a second polarization, opposite to said first polarization.

Still according to the invention, said switch circuit could include first switching means arranged in series with said solenoid and with said PTC resistor, suitable to allow the passage of current as a consequence of said activation signals, and second switching means, arranged in parallel with said solenoid, suitable to allow the passage of current as a consequence of said protection signals.

Advantageously according to the invention, said first and said second switching means could include diodes, said switch circuit includes a first diode, having an anode and a cathode, said cathode being connected with said first electric terminal of said solenoid, and a second diode, having an anode and a cathode, said anode being connected between said second electric terminal of said solenoid and said PTC resistor, and the cathode being connected with said anode of said first diode, said activation and protection signals being applied to said anode of said first diode, and said activation signals are comprised of pulses with positive polarization and in that said protection signals are comprised of pulses with negative polarization.

Further according to the invention, said first and said second switching means could comprise diodes, said switch circuit could comprise a first diode, having an anode and a cathode, said anode being connected with said first electric terminal of said solenoid, and a second diode, having an anode and a cathode, said cathode being connected between said second electric terminal of said solenoid and said PTC resistor, and the anode being connected with said cathode of said first diode, said activation and protection signals being applied to said cathode of said first diode, and said activation signals are comprised of pulses with negative polarization and in that said protection signals are comprised of pulses with positive polarization.

Always according to the invention, said switch circuit could include switching means, arranged in parallel to said solenoid, suitable to allow the passage of current as a consequence of said protection signals.

Still according to the invention, said switch means could comprise diodes, said switch circuit comprising a diode, having an anode and a cathode, such that: said cathode is connected between said second electric terminal of said solenoid and said PTC resistor, and the anode is connected with said first electric terminal of said solenoid, said activation and protection signals being applied to said anode, and said activation signals being comprised of pulses with negative polarization and said protection signals are comprised of pulses with positive polarization; or said anode being connected between said second electric terminal of said solenoid and said PTC resistor, and the cathode is connected with said first electric terminal of said solenoid, said activation and protection signals being applied to said cathode, and said activation signals being comprised of pulses with positive polarization and in that said protection signals being comprised of pulses with negative polarization.

Always according to the invention, said actuating unit could include a core, preferably made of a magnetizable material, said core being movable due to the electromagnetic field generated by said solenoid, said core having a first and a second ends, and said actuating unit comprising a mechanical member having a first end connected to said first end of said core, and a hook-shaped second end.

Still according to the invention, said actuator module could comprise a safety unit and a control mechanism.

Advantageously said safety unit of the actuator module comprises a bi-metal foil capable to deform its own shape as a consequence of the increase in temperature to which it is subjected, a further PTC, placed higher than said bi-metal foil, so as to be in thermal and electrical contact with it, and a lever, which is in contact with said resistor, said control mechanism comprises a safety pin, capable to assume a resting position, where it is retracted, and an active position or extracted, and a toothed wheel, preferably a saw-toothed wheel, said safety pin being arranged in said toothed wheel and being connected to said lever, said toothed wheel being capable to release said safety pin as a consequence of at least one rotation step, so that it can take said active position, and as a consequence of at least one additional step said toothed wheel being capable of preventing said safety pin to assume said active position, and said second end of said mechanical member being engaged with said toothed wheel, so that it may cause a rotation step of said toothed wheel at every excitation of said solenoid.

Further according to the invention, said solenoid could be the stator of an electric motor or a turbine stator or the activation coil of a relay.

It is further object of the present invention a system for locking-unlocking a door of a household appliance, such as a washing machine, comprising a mechanic module suitable to hold or release a prong integral to the door of said household appliance, and an actuator module as defined above, such that when said safety pin of said actuator module assumes said rest position, said actuator module does not interact with said mechanic module, while when said safety pin assumes said active position said actuator module interacts with said mechanical module to prevent the release of that prong of said door, and a control logic unit suitable to generate said activation and protection signals on said first and second electric terminal of said solenoid, said control logic unit being capable of generating signals for activation and protection of said actuator module.

It is also object of the present invention a method for protecting a locking-unlocking system as defined above, comprising the following step:

generating a protection signal, in order to increase the resistance of said PTC resistor for the whole time interval in which it is desired to protect said system.

Always according to the invention, said method could comprise the following additional steps:

before said generation step of said protection signal, generating a first activation signal from said control logic unit, so as to set said safety pin in said active position, and after said step of generation of said protection signal, generating a second activation signal from said control logic unit, so as to set said safety pin in said rest position.

Still according to the invention, said first activation signal could comprise an electrical pulse having a first polarization, said second activation signal comprises a plurality of electrical pulses having said first polarization, and said protection signal is comprised of a plurality of electrical pulses having a second polarization, opposite to said first polarization.

The present invention will be now described, for illustrative but not limitative purposes, according to its preferred embodiments, with particular reference to the figures of the enclosed drawings, wherein.

In the various figures, similar parts will be indicated by the same reference numbers.

Figure 1:
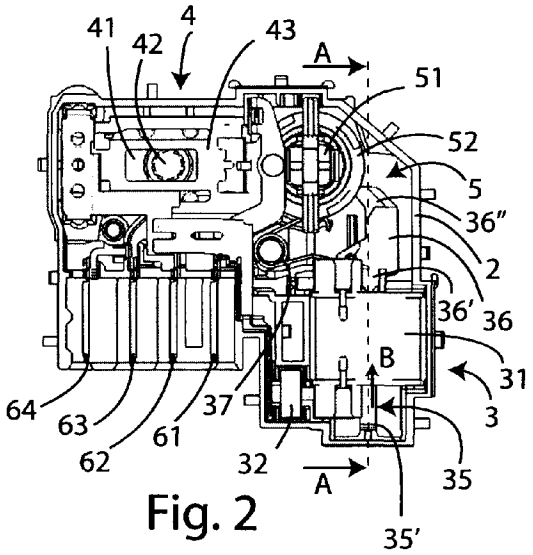
FIG. 1 shows a perspective view of an opened actuator module.
Figure 2:
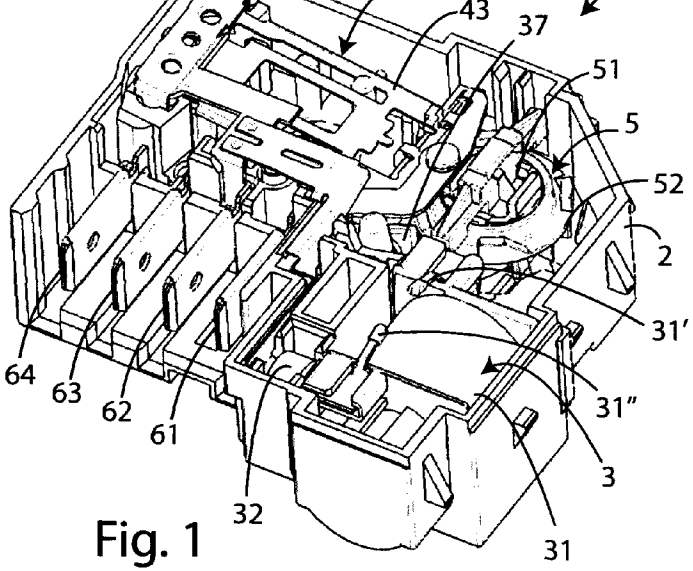
FIG. 2 shows a plan view of the opened actuator module.
Figure 4:
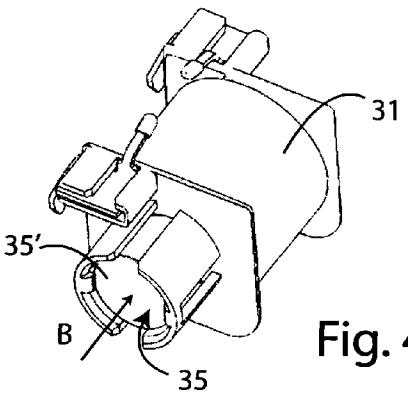
FIG. 4 shows a perspective view of the solenoid.
Figure 3:
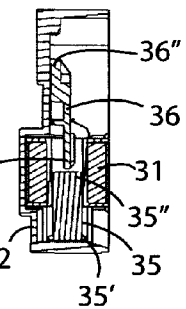
FIG. 3 shows a section along the line A-A.

Making reference to FIGS. 1 to 4, it is seen an actuator module 1 having an enclosure 2, wherein an actuating unit 3, a safety unit 4, a control mechanism 5 of a safety pin 51, and control terminals 61, 62, 63 and 64, which are connected to a control logic unit, not shown in the figures, are provided.

Figure 5:
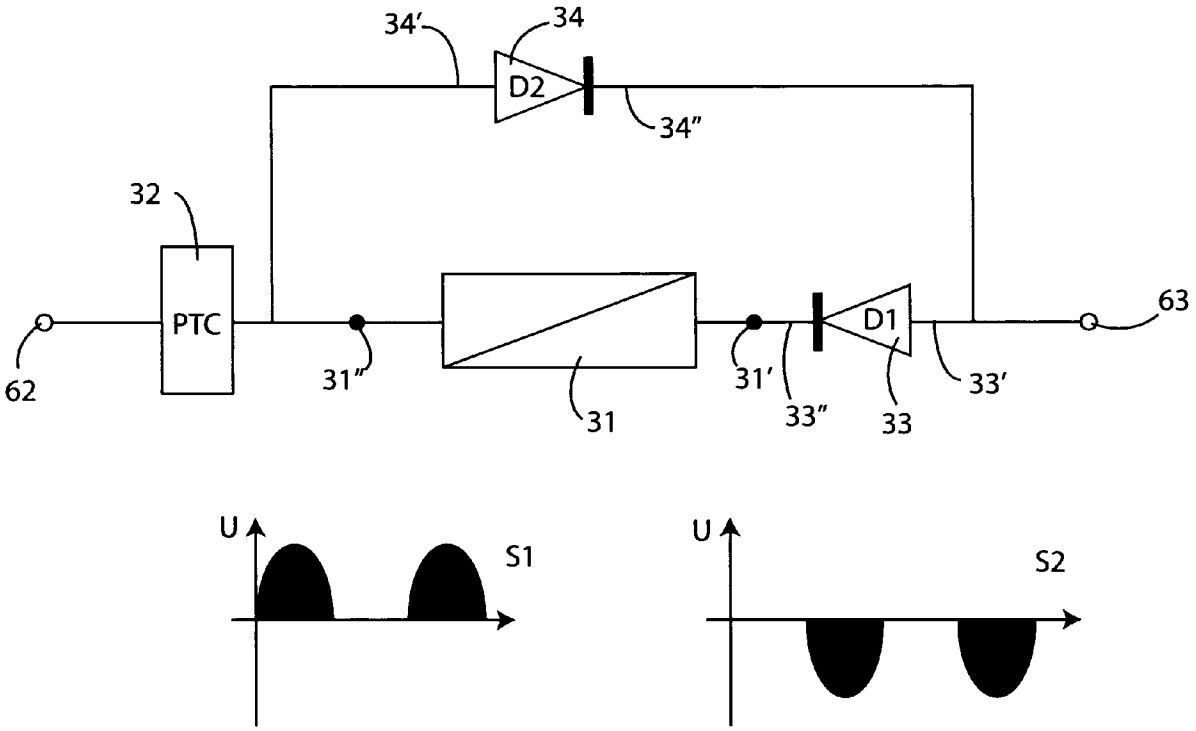
FIG. 5 shows an electric scheme of the power supply of a solenoid of the actuator module according to the present invention.

The actuating unit 3 comprises a solenoid 31, which has a first 31' and a second 31" electrical terminal for its power supply. This actuating unit 3 also includes a PTC resistor 32 (Positive Temperature Coefficient Resistor), connected as shown in FIG. 5, i.e. in series with said solenoid 31 in particular with the terminal 31". In addition, a switch circuit is also provided, comprising a first diode 33, connected in order to have the anode 33' connected with said control terminal 63 and the cathode 33" connected with the terminal 31' of the solenoid 31, and a second diode 34, with the anode 34' connected with said terminal 31" of the solenoid 31 and the cathode 34" connected with the control terminal 63.

Said actuator unit 3 also comprises a movable core 35 not magnetized in this embodiment, but made of a material magnetizable by a magnetic field, said movable core 35 having a first end 35' and a second end 35". Said movable core 35 is arranged within said solenoid 31 and is capable to take a rest position, in which it is at least partially extracted from said solenoid 31 and said first ends 35 is substantially adjacent (abutted) to enclosure 2, and an operating position, in which it is moved in the direction B, arranging within said solenoid 31, so that said first end 35' is spaced away from the enclosure 2.

Finally, said actuating unit 3 also comprises an actuating member 36 having a first end 36' coupled with said movable core 35, and a second end 36" having a hook shape. A return spring 37 of said actuating member 36 is also provided.

Safety unit 4 comprises a substantially bi-metal plate 41, electrically connected with said terminal 64, which is able to deform its shape (curving) due to the temperature increase to which it is subjected, a further PTC resistor 42, arranged above said bi-metal plate 41, so as to be in thermal and electrical contact with it, and a lever 43 in contact with said resistor 42. More details on the operation of said safety unit 4 will be given below.

The control mechanism 5 comprises, in addition to the safety pin 51, a saw-toothed wheel 52. Said safety pin 51 is arranged along the symmetry axis of said saw-toothed wheel 52, within the same, and it is in its turn connected with said lever 43.

Safety pin 51 can assume a rest position (retracted), in which it does not interact with a mechanical module to hold or release a prong integral to the door of the washing machine, and an active position or extracted (considering FIG. 2, the extracted position is when the safety pin 51 moves entering in the sheet), in which it interacts with said mechanical module, when the door is closed and the washing machine is turned on, preventing the opening of the door.

Said second end 36" is capable of engaging with said teeth of said saw-toothed wheel 52. This saw-toothed wheel 52 moves by steps with a preset rotation angle corresponding to a tooth, which in this case are 12. After a first step, said saw-toothed wheel 52 releases safety pin 51, so that it can also assume said active position or extracted, while, after at least one additional step (in this embodiment 2), saw-toothed wheel 52 prevents said safety pin 51 to assume said active position or extracted.

The operation of the actuator module 1 described above is as follows.

When the door of the washing machine is closed and the washing machine is activated by an appropriate command, control logic unit transmits a signal on the terminal 64 such that an electric current through said additional PTC resistor 42 flows. The latter raises its temperature and hence that of the bi-metal plate 41, which curves, lifting the PTC resistor 42 and activating the lever 43. This one, in turn, exerts a force on the safety pin 51 to enable it, when it is free, to arrange in said active position or extracted, to assume which said safety pin 51 is prevented by saw-toothed wheel 52, which is in the position to prevent said safety pin 51 to assume said active position or extracted. Then, or substantially at the same time, the control logic unit generates between terminals 63 and 62 a signal having the waveform of the signal S1, shown in FIG. 5, which comprises electrical pulses positively polarized with respect to a common terminal (positive half-waves).

Typically said control logic unit generates a single positive pulse or a positive half wave, of, in this case, 10 milliseconds. In this way, said first diode 33 is positively polarized, an electric current through solenoid 31 flows, which, by generating an appropriate magnetic field, passes said movable core 35 from said rest position to said operating position. Said actuator member 36, by the second end 36", rotates the saw-toothed wheel 52 of one-twelfth, i.e. making a step, thus releasing the safety pin 51 that therefore passes from said rest position (retracted) to said active position or extracted, under the influence of the force exerted by said lever 43. In this way, said safety pin 51 interacts with said mechanical module to prevent opening the door.

The current flowing through the solenoid 31, and then through the PTC resistor 32, has a very short duration (a pulse or a half-wave), as said above of about 10 milliseconds, and in any case short enough to allow the PTC resistor 32 not to increase appreciably its resistance. Meanwhile, said second diode 34 is inhibited. The actuating member 36, due to the return spring 37, returns to a position of disengagement from the tooth of the saw-toothed wheel 52, when the pulse S1 ends and the movable core 35 returns in rest position.

In case of multiples positive pulses were generated, for example due to a malfunction of the control logic unit, the PTC resistor 32 heats up, reaching, after about 1 second, a high resistance, of the order of 15 megaohms, so as to simulate a open circuit and to protect the solenoid 31 from overheating.

When the safety pin 51 is in the active position, said control logic unit between terminals 63 and 62 generates a signal having the waveform signal S2, which includes trains of negative half-waves, which polarity is opposite to that of the activation signal S1, as shown in FIG. 5, keeping the negative voltage on the terminal 63. In this way, said first diode 33 is inhibited thus preventing the solenoid 31 to be powered, and said second diode 34 conducts. Current can flow through the PTC resistor 32. Therefore, said PTC resistor 32 heats up and after about 1 second reaches a high resistance, of the order of 15 megaohms, to simulate an open circuit. In this condition, the washing machine is in safety condition, which is appropriate while for example it runs a centrifuge, i.e. a program for which opening the door could be very dangerous. In fact, if even a positive polarization signal were generated, no current could pass through the solenoid 31, due to the high resistance of the PTC 32, which effectively simulates an open circuit.

Furthermore, it is to be noted that while the PTC resistor 32 increases its resistance, for a time interval of the order of about one or two seconds, no current flows through the solenoid 31. Therefore, in this time interval no noise or hum is generated due to movement of said movable core 35, which is in rest position.

When washing machine (or appliance in general) has completed the operation program, said control logic unit interrupts the signal S2, that is a train of negative pulses, between terminals 63 and 62, and after an appropriate time interval, required to reduce the temperature of the PTC 32 and, thus, to reduce its resistance, said control logic unit transmits two positive pulses (S1), so that said saw-toothed wheel 52 makes two steps to bring said safety pin 51 in said rest position, i.e. retracted.

In general, for reducing the recovery time of the PTC resistor 32, a heat sink element in thermal contact with it is provided.

At the same time, then, said control logic unit interrupts the current flow through said additional PTC resistor 42, which, cooling together with said bimetal, allows the latter to return to its natural shape, disabling the lever 43, so exercising no more force on the safety pin 51.

The switch circuit can be realized by reversing the arrangement of the diodes, also providing the polarity inversion of said activation and protection signals. Furthermore, other kinds of switch devices can be provided in addition to the diode.

Figure 6:
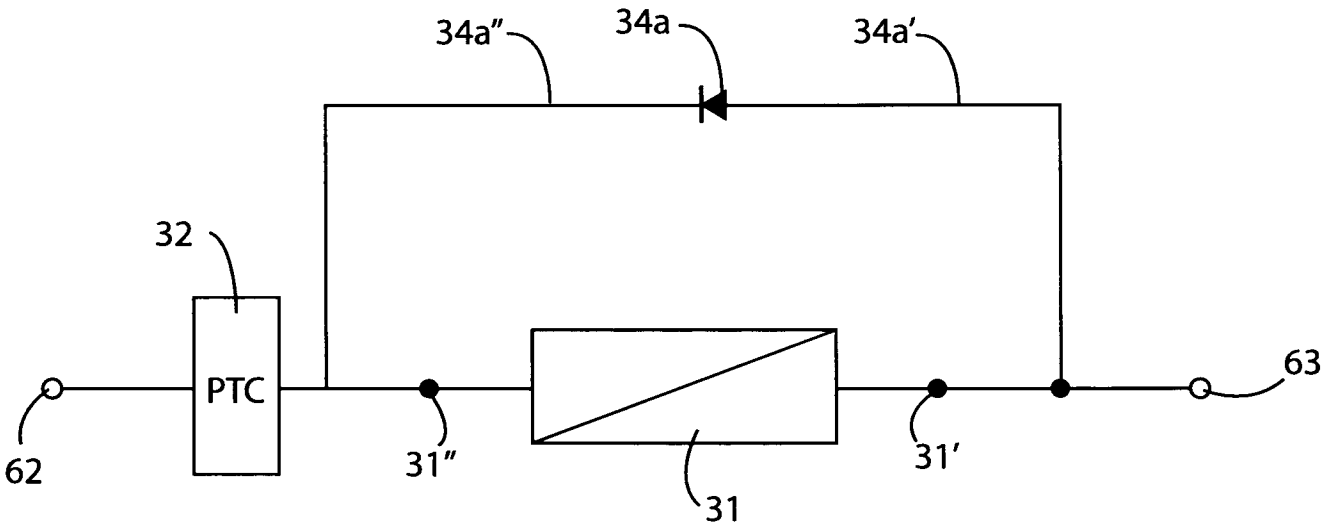
FIG. 6 shows the electric scheme of the power supply of a solenoid of the actuator module according to a further embodiment of the present invention.

FIG. 6 also shows the power supply electric scheme of a solenoid of the actuator module according to a further embodiment of the present invention, which provides only a diode 34*a* arranged in parallel to the solenoid 31. Said diode 34*a* has an anode 34*a'* and a cathode 34*a"*. The cathode 34*a"* is connected between said second electrical terminal 31" of said solenoid 31 and said PTC resistor 32, and the anode 34*a'* is connected with said first electrical terminal 31' of said solenoid 31.

Said activation signals and protection signals can be applied to said anode 34*a'*. In this case, said activation signals are comprised of pulses with negative polarization and said protection signals are comprised of pulses with positive polarization.

In this case, the scheme, however, allows the correct detection of the "protection" pulses train, i.e. pulses that directly polarize the diode 34*a*, so as to power only the protection PTC. The normal operation, in which the PTC resistor 32 does not heat up enough to stop the flow of current, would be ensured by a power supply containing half-waves of both polarities due to the reactivity of the mechanism, as pulses of about 5 milliseconds are sufficient to activate the solenoid 31 but are not sufficient to trigger the protection PTC 32, which has to be powered for a few seconds (about 2 to 3 seconds). Therefore, with a signal such as a complete sinusoid, a control impulse only valid for solenoid 31 would be got.

Even in this case, the polarities of the diode and then of the activation and protection signals, may be reversed.

Finally, the actuator module according to the invention can also be applied to electric motors, relay coils or turbines.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. An actuator module (1) comprising an actuating unit (3), said actuating unit comprising a solenoid (31) having a first (31') and a second (31") electric terminal, capable, when excited, of generating an electromagnetic field and a PTC (Positive Temperature Coefficient) resistor (32) connected in series with said second electric terminal (31) of said solenoid (31), said actuator module (1) being characterized in that said actuating unit (3) can be controlled by activation signals and protection signals, and in that it comprises a switch circuit (33, 34), connected between said first (31') and second (31") electric terminal, said switch circuit (33, 34) allowing the passage of current through said solenoid (31) and said PTC resistor (32) by said activation signals; and preventing the passage of current through said solenoid (31), but allowing the passage of current through said PTC resistor (32), by said protection signals.

2. The actuator module (1) according to claim 1, wherein said activation signals are constituted of pulses having a first polarization and said protection signals are constituted of pulses having a second polarization, opposite to said first polarization.

3. The actuator module (1) according to claim 1, wherein said switch circuit includes first switching means (33) arranged in series with said solenoid (31) and with said PTC resistor (32), suitable to allow the passage of current as a consequence of said activation signals, and second switching means (34), arranged in parallel with said solenoid (31), suitable to allow the passage of current as a consequence of said protection signals.

4. The actuator module (1) according to claim 2, wherein said switch circuit includes first switching means (33) arranged in series with said solenoid (31) and with said PTC resistor (32), suitable to allow the passage of current as a consequence of said activation signals, and second switching means (34), arranged in parallel with said solenoid (31), suitable to allow the passage of current as a consequence of said protection signals.

5. The actuator module (1) according to claim 4, wherein said first and said second switching means include diodes, in that said switch circuit includes a first diode (33), having an anode (33') and a cathode (33"), said cathode (33") being connected with said first electric terminal (31') of said solenoid (31), and a second diode (34), having an anode (34') and a cathode (34"), said anode (34') being connected between said second electric terminal (31") of said solenoid (31) and said PTC resistor (32), and the cathode (34") being connected with said anode (33') of said first diode (33), said activation and protection signals being applied to said anode (33') of said first diode (33), and in that said activation signals are comprised of pulses with positive polarization and in that said protection signals are comprised of pulses with negative polarization.

6. The actuator module (1) according to claim 4, wherein said first and said second switching means comprise diodes, in that said switch circuit comprises a first diode (33), having an anode (33') and a cathode (33"), said anode (33') being connected with said first electric terminal (31') of said solenoid (31), and a second diode (34), having an anode (34') and a cathode (34"), said cathode (34") being connected between said second electric terminal (31") of said solenoid (31) and said PTC resistor (32), and the anode (34') being connected with said cathode (33) of said first diode (33), said activation and protection signals being applied to said cathode (33) of said first diode (33), and in that said activation signals are comprised of pulses with negative polarization and in that said protection signals are comprised of pulses with positive polarization.

7. The actuator module (1) according to claim 1, wherein said switch circuit includes switching means (34*a*), arranged in parallel to said solenoid (31), suitable to allow the passage of current as a consequence of said protection signals.

8. The actuator module (1) according to claim 2, wherein said switch circuit includes switching means (34*a*), arranged in parallel to said solenoid (31), suitable to allow the passage of current as a consequence of said protection signals.

9. The actuator module (1) according to claim 8, wherein said switch means comprise diodes, said switch circuit comprising a diode (34*a*), having an anode (34') and a cathode (34*a"*), such that said cathode (34*a"*) is connected between said second electric terminal (31") of said solenoid (31) and said PTC resistor (32), and the anode (34*a'*) is connected with said first electric terminal (31') of said solenoid, said activation and protection signals being applied to said anode (34*a'*), and said activation signals being comprised of pulses with negative polarization and said protection signals are comprised of pulses with positive polarization; or said anode (34*a'*) being connected between said second electric terminal (31") of said solenoid (31) and said PTC resistor (32), and the cathode (34*a"*) is connected with said first electric terminal (31') of said solenoid (31), said activation and protection signals being applied to said cathode (34*a*″), and said activation signals being comprised of pulses with positive polarization and in that said protection signals being comprised of pulses with negative polarization.

10. The actuator module (1) according to claim 1, wherein said actuating unit (3) includes a core (35), preferably made of a magnetizable material, said core being movable due to the electromagnetic field generated by said solenoid (31), said core (35) having a first (35') and a second (35") ends, and said actuating unit (3) comprising a mechanical member (36) having a first end (36') connected to said first end (35") of said core (35), and a hook-shaped second end (36").

11. The actuator module (1) according to claim 2, wherein said actuating unit (3) includes a core (35), preferably made of a magnetizable material, said core being movable due to the electromagnetic field generated by said solenoid (31), said core (35) having a first (35') and a second (35") ends, and said actuating unit (3) comprising a mechanical member (36) having a first end (36') connected to said first end (35") of said core (35), and a hook-shaped second end (36").

12. The actuator module (1) according to claim 1, wherein actuator module comprises a safety unit (4) and a control mechanism (5).

13. The actuator module (1) according to claim 12, wherein said safety unit (4) comprises a bi-metal foil (41) capable to deform its own shape as a consequence of the increase in temperature to which it is subjected, a further PTC (42), placed higher than said bi-metal foil (41), so as to be in thermal and electrical contact with it, and a lever (43), which is in contact with said resistor (42), said control mechanism (5) comprises a safety pin (51), capable to assume a resting position, where it is retracted, and an active position or extracted, and a toothed wheel, preferably a saw-toothed (52) wheel, said safety pin (51) being arranged in said toothed wheel (52) and being connected to said lever (43), said toothed wheel (52) being capable to release said safety pin (51) as a consequence of at least one rotation step, so that it can take said active position, and as a consequence of at least one additional step said toothed wheel (52) being capable of preventing said safety pin (51) to assume said active position, and in that said second end (36) of said mechanical member (36) being engaged with said toothed wheel (52), so that it may cause a rotation step of said toothed wheel (52) at every excitation of said solenoid (31).

14. The actuator module (1) according to claim 1, wherein said solenoid (31) is the stator of an electric motor or a turbine stator or the activation coil of a relay.

15. A system for locking-unlocking a door of a household appliance, such as a washing machine, comprising a mechanic module suitable to hold or release a prong integral to the door of said household appliance, and an actuator module (1) as defined in claim 1, such that when said safety pin (51) of said actuator module (1) assumes said rest position, said actuator module (1) does not interact with said mechanic module, while when said safety pin (51) assumes said active position said actuator module (1) interacts with said mechanical module to prevent the release of that prong of said door, and a control logic unit suitable to generate said activation and protection signals (S1, S2) on said first (31') and second (31") electric terminal of said solenoid (31), said control logic unit being capable of generating signals for activation and protection of said actuator module (1).

16. A method for protecting a locking-unlocking system as defined in claim 15, comprising:

generating a protection signal (S2), in order to increase the resistance of said PTC resistor (32) for the whole time interval in which it is desired to protect said system.

17. A method according to claim 16, wherein locking-unlocking system comprises:

before said generation step of said protection signal (S2), generating a first activation signal (S1) from said control logic unit, so as to set said safety pin (51) in said active position, and after said step of generation of said protection signal (S2), generating a second activation signal (S1) from said control logic unit, so as to set said safety pin (51) in said rest position.

18. A method according to claim 17, wherein said first activation signal comprises an electrical pulse having a first polarization, said second activation signal comprises a plurality of electrical pulses having said first polarization, and said protection signal is comprised of a plurality of electrical pulses having a second polarization, opposite to said first polarization.

* * * * *